US011664591B2

(12) United States Patent
Ke

(10) Patent No.: US 11,664,591 B2
(45) **Date of Patent: *May 30, 2023**

(54) ANTENNA STRUCTURE, ELECTRONIC DEVICE AND ARRAYING METHOD FOR ANTENNA STRUCTURE

(71) Applicant: BEIJING XIAOMI MOBILE SOFTWARE CO., LTD., Beijing (CN)

(72) Inventor: Changqing Ke, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 380 days.

This patent is subject to a terminal disclaimer.

(21) Appl. No.: 16/683,186

(22) Filed: Nov. 13, 2019

(65) Prior Publication Data

US 2020/0388914 A1 Dec. 10, 2020

(30) Foreign Application Priority Data

Jun. 6, 2019 (CN) ..... 201910493481.7

(51) Int. Cl.
*H01Q 3/24* (2006.01)
*H01Q 21/00* (2006.01)
*H01Q 1/24* (2006.01)

(52) U.S. Cl.
CPC ..... *H01Q 3/24* (2013.01); *H01Q 21/0018* (2013.01); *H01Q 1/246* (2013.01)

(58) Field of Classification Search
USPC ..... 342/371, 374, 368
See application file for complete search history.

(56) References Cited

U.S. PATENT DOCUMENTS

| | | | | |
|---|---|---|---|---|
| 6,067,048 | A | 5/2000 | Yamada | |
| 8,159,394 | B2 * | 4/2012 | Hayes | H01Q 21/205 342/368 |
| 10,381,746 | B2 | 8/2019 | Zihir et al. | |
| 10,559,878 | B2 | 2/2020 | Rezvani | |
| 2003/0022693 | A1 | 1/2003 | Gerogiokas | |
| 2003/0083016 | A1 | 5/2003 | Evans | |

(Continued)

FOREIGN PATENT DOCUMENTS

| | | | |
|---|---|---|---|
| CN | 1261989 | A | 8/2000 |
| CN | 1572066 | A | 1/2005 |

(Continued)

OTHER PUBLICATIONS

European Search Report in the European application No. 19214340.2, dated Jun. 19, 2020.

(Continued)

*Primary Examiner* — Bo Fan
(74) *Attorney, Agent, or Firm* — Syncoda LLC; Feng Ma

(57) ABSTRACT

An antenna structure includes: a plurality of array elements; at least one radio frequency component, including a plurality of feed ports; and a radio frequency switch, wherein the radio frequency switch is connected to at least two array elements and at least two feed ports of the at least one radio frequency component, the radio frequency switch is configured to switch a feed object of each feed port connected to the radio frequency switch to form a preset antenna array, and the feed object is any array element of the at least two array elements connected to the radio frequency switch.

15 Claims, 8 Drawing Sheets

(56) References Cited

U.S. PATENT DOCUMENTS

| | | | | |
|---|---|---|---|---|
| 2008/0158054 | A1 | 7/2008 | Su-Khiong | |
| 2015/0194736 | A1 | 7/2015 | Diukman et al. | |
| 2015/0263424 | A1* | 9/2015 | Sanford | H01Q 1/1228 342/371 |
| 2017/0195004 | A1 | 7/2017 | Cheng et al. | |
| 2017/0353338 | A1 | 12/2017 | Amadjikpe et al. | |
| 2018/0034150 | A1 | 2/2018 | Rezvani | |
| 2018/0123229 | A1 | 5/2018 | Stratis et al. | |
| 2019/0020123 | A1 | 1/2019 | Petersson et al. | |
| 2019/0089067 | A1 | 3/2019 | Zihir et al. | |
| 2019/0089070 | A1 | 3/2019 | Zihir et al. | |
| 2019/0089316 | A1 | 3/2019 | Zihir et al. | |
| 2019/0089402 | A1 | 3/2019 | Zihir et al. | |
| 2019/0115658 | A1 | 4/2019 | Iannotti et al. | |
| 2019/0166523 | A1 | 5/2019 | Shaw et al. | |
| 2019/0312360 | A1 | 10/2019 | Zihir et al. | |
| 2019/0393599 | A1 | 12/2019 | Rezvani | |
| 2020/0028562 | A1 | 1/2020 | Yang | |
| 2020/0176865 | A1 | 6/2020 | Rezvani | |

FOREIGN PATENT DOCUMENTS

| | | | |
|---|---|---|---|
| CN | 1815914 | A | 8/2006 |
| CN | 101212084 | A | 7/2008 |
| CN | 201191650 | Y | 2/2009 |
| CN | 102177662 | A | 9/2011 |
| CN | 102496787 | A | 6/2012 |
| CN | 102646874 | A | 8/2012 |
| CN | 103439686 | A | 12/2013 |
| CN | 103856226 | A | 6/2014 |
| CN | 103874076 | A | 6/2014 |
| CN | 203982394 | U | 12/2014 |
| CN | 105098362 | A | 11/2015 |
| CN | 105390825 | A | 3/2016 |
| CN | 105870588 | A | 8/2016 |
| CN | 106332318 | A | 1/2017 |
| CN | 106410413 | A | 2/2017 |
| CN | 206040972 | U | 3/2017 |
| CN | 106961019 | A | 7/2017 |
| CN | 107394393 | A | 11/2017 |
| CN | 107404332 | A | 11/2017 |
| CN | 207766262 | U | 8/2018 |
| CN | 108493575 | A | 9/2018 |
| CN | 207992440 | U | 10/2018 |
| CN | 108988903 | A | 12/2018 |
| CN | 109004373 | A | 12/2018 |
| CN | 109216944 | A | 1/2019 |
| CN | 109524797 | A | 3/2019 |
| CN | 209948060 | U | 1/2020 |
| EP | 1280285 | A1 | 1/2003 |
| EP | 3599664 | A1 | 1/2020 |
| JP | H11-231040 | A | 8/1999 |
| JP | 2000258524 | A | 9/2000 |
| KR | 100842087 | B1 | 6/2008 |
| KR | 100924918 | B1 | 11/2009 |
| KR | 20150044726 | A | 4/2015 |
| KR | 101772206 | B1 | 8/2017 |
| KR | 101937820 | B1 | 1/2019 |
| RU | 2499354 | C2 | 11/2013 |
| WO | 03034614 | A1 | 4/2003 |
| WO | 2015056989 | A1 | 4/2015 |
| WO | 2018088745 | A1 | 5/2018 |
| WO | 2018142132 | A1 | 8/2018 |
| WO | 2018171600 | A1 | 9/2018 |
| WO | 2018203081 | A1 | 11/2018 |

OTHER PUBLICATIONS

First Office Action of the Russian application No. 2019139963, dated Jul. 21, 2020.

Second Office Action of the Chinese application No. 201910493481.7, dated Aug. 24, 2021.

First Office Action of the Chinese application No. 201910493481.7, dated Mar. 8, 2021.

Second Office Action of the Korean application No. 10-2019-7033984, dated Mar. 18, 2021.

First Office Action of the Chinese application No. 201910493480.2, dated Mar. 5, 2021.

First Office Action of the Russian application No. 2019139773, dated Jun. 15, 2020.

Supplementary European Search Report in the European application No. 19213730.5, dated Jun. 17, 2020.

International Search Report in the international application No. PCT/CN2019/110901, dated Feb. 26, 2020.

Non-Final Office Action of the U.S. Appl. No. 16/689,038, dated Feb. 23, 2021.

International Search Report in the international application No. PCT/CN2019/111307, dated Feb. 27, 2020.

First Office Action of the European application No. 19214340.2, dated May 3, 2022.

Chenxi Hu et al, "Random switch antenna array FMCW radar and its signal processing method", 2012 IEEE 7th Sensor Array and Multichannel Signal Processing Workshop (SAM), doi:10.1109/sam.2012.6250493.

Yang Shenghua et al, "A Millimeter-wave Two-dimensional Electronic Scanning Active Phased Array Radar", Telecommunication Engineering, vol. 52 No.5, May 2012.

First Office Action of the European application No. 19213730.5, dated Oct. 19, 2022.

* cited by examiner

ANTENNA STRUCTURE, ELECTRONIC DEVICE AND ARRAYING METHOD FOR ANTENNA STRUCTURE

CROSS-REFERENCE TO RELATED APPLICATION

This application claims priority to Chinese patent application No.

201910493481.7 filed on Jun. 6, 2019, the disclosure of which is hereby incorporated by reference in its entirety.

BACKGROUND

At present, 5th-Generation (5G) mobile communication networks have been rapid research and development, which has a transmission speed hundreds of times faster than a 4th-generation mobile communication network that is still widely used.

SUMMARY

Embodiments of the present disclosure generally relate to the technical field of terminals, and more specifically to an antenna structure, an electronic device and an arraying method and device for the antenna structure.

According to a first aspect of the embodiments of the present disclosure, an antenna structure is provided, which can include:

a plurality of array elements;

at least one radio frequency component, including a plurality of feed ports; and a radio frequency switch, wherein the radio frequency switch may be connected to at least two array elements and at least two feed ports of the at least one radio frequency component, the radio frequency switch may be configured to switch a feed object of each feed port connected to the radio frequency switch to form a preset antenna array, and the feed object may be any array element of the at least two array elements connected to the radio frequency switch.

In some embodiments, the at least one radio frequency component can include a single radio frequency component, the single radio frequency component including a plurality of feed ports, all the plurality of feed ports being connected to the radio frequency switch.

In some embodiments, the at least one radio frequency component can include a plurality of radio frequency components, each of at least one first radio frequency component of the plurality of radio frequency components can include a plurality of feed ports, and each feed port can correspond to at least one array element; and each of the at least one first radio frequency component can be connected to the radio frequency switch, and the radio frequency switch can be configured to switch a feed object corresponding to each feed port.

In some embodiments, a distance between two adjacent array elements can be less than or equal to a wavelength when the antenna structure is at a preset working frequency.

In some embodiments, the plurality of array elements can be arranged in a preset range, and the preset range can be a range taking an arrangement center of the plurality of array elements as a circle center and taking two times of wavelength when the antenna structure is at the preset working frequency as a radius.

In some embodiments, the plurality of array elements can be arranged in one of shapes comprising:

a round, a square, a cross and a straight line.

In some embodiments, the antenna structure can include a 5G millimeter wave antenna.

According to a second aspect of the embodiments of the present disclosure, an electronic device is provided, which can include the antenna structure of any abovementioned embodiment.

According to a third aspect of the embodiments of the present disclosure, an arraying method for an antenna structure is provided, the antenna structure including a plurality of array elements, at least one radio frequency switch and a radio frequency component, the arraying method including that:

any number of array elements required by arraying in the plurality of array elements are determined; and the radio frequency switch is regulated to pair feed ports of the radio frequency component and the any number of array elements one by one to form an antenna array.

According to a fourth aspect of the embodiments of the present disclosure, an arraying device for an antenna structure is provided, the antenna structure including a plurality of array elements, at least one radio frequency switch and a radio frequency component, the arraying device including:

a determination portion, configured to determine any number of array elements required by arraying in the plurality of array elements; and a regulation portion, configured to regulate the radio frequency switch to pair feed ports of the radio frequency component and the any number of array elements one by one to form an antenna array.

According to a fifth aspect of the embodiments of the present disclosure, a computer-readable storage medium is provided, in which a computer instruction can be stored, the instruction being executed by a processor to implement the steps of any abovementioned method.

According to a sixth aspect of the embodiments of the present disclosure, an electronic device is provided, which can include:

a processor; and a memory configured to store processor-executable instructions, wherein the processor can be configured to execute the steps of the method of any abovementioned embodiment.

It is to be understood that the above general descriptions and detailed descriptions below are only exemplary and explanatory and not intended to limit the present disclosure.

BRIEF DESCRIPTION OF THE DRAWINGS

The accompanying drawings referred to in the specification are a part of this disclosure, and provide illustrative embodiments consistent with the disclosure and, together with the detailed description, serve to illustrate some embodiments of the disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of apparatuses and methods consistent with aspects related to the present disclosure as recited in the appended claims.

Terms used in the present disclosure are only adopted for the purpose of describing specific embodiments and not intended to limit the present disclosure. "A/an," "said" and "the" in a singular form in the present disclosure and the appended claims are also intended to include a plural form, unless other meanings are clearly denoted throughout the present disclosure. It is also to be understood that term "and/or" used in the present disclosure refers to and includes one or any or all possible combinations of multiple associated items that are listed.

It is to be understood that, although terms first, second, third and the like may be adopted to describe various information in the present disclosure, the information should not be limited to these terms. These terms are only adopted to distinguish the information of the same type. For example, without departing from the scope of the present disclosure, first information may also be called second information and, similarly, second information may also be called first information. For example, term "if" used here may be explained as "while" or "when" or "responsive to determining," which depends on the context.

Based on rapid development of the 5G mobile communication networks, a requirement on an antenna structure in an electronic device also increases. For example, for meeting a communication requirement, multiple antenna arrays are usually required to be arranged in an electronic device to meet the communication requirement.

Figure 1:
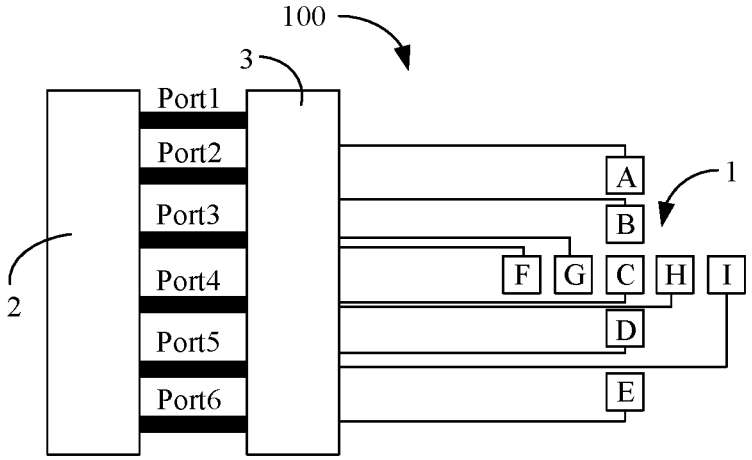
FIG. 1 is a portion block diagram of an antenna structure, according to some embodiments of the present disclosure.

FIG. 1 is a portion block diagram of an antenna structure, according to some embodiments of the present disclosure. As illustrated in FIG. 1, the antenna structure 100 can include a plurality of array elements 1, a radio frequency component 2 and a radio frequency switch 3. As illustrated in FIG. 1, the antenna structure 100 can include nine antenna elements and, of course, in another embodiment, can include another number of array elements, for example, eight array elements or ten array elements. There are no limits made in the embodiment of the present disclosure. The radio frequency component 2 can also include a plurality of feed ports, and the radio frequency switch 3 can be connected with at least two array elements in the nine array elements and at least two ports of the radio frequency component 2. For example, in FIG. 1, the radio frequency switch 3 is connected with the nine array elements of the antenna structure 100 and six feed ports of the radio frequency component 2, the radio frequency switch 3 can be configured to shift a feed object of each feed port, connected with the radio frequency switch 3, of the radio frequency component 2, and the feed object is any array element of the at least two array elements connected to the radio frequency switch 3, so that a connection relationship between the feed ports and the array elements can be regulated to obtain multiple different array elements to form different preset antenna arrays.

For example, as illustrated in FIG. 1, for convenient description, in the embodiment, each array element in the plurality of array elements 1 is denoted by a letter, and the plurality of array elements 1 can include array elements A, B, C, D, E, F, G, H and I; the radio frequency component 2 can include the six feed ports Port1, Port2, Port3, Port4, Port5 and Port6; in a state, connection between the array element A and the Port1, between the array element B and the Port2, between the array element C and the Port3, between the array element D and the Port4, between the array element E and the Port5 and between the array element F and the Port6 can be implemented by shifting of the radio frequency switch 3, thereby obtaining a first antenna array formed by the array elements A, B, C, D, E and F; and in another state, connection between the array element A and the Port1, between the array element B and the Port2, between the array element C and the Port3, between the array element D and the Port4, between the array element E and the Port5 and between the array element G and the Port6 can also be implemented by shifting of the radio frequency switch 3, thereby obtaining a second antenna array formed by the array elements A, B, C, D, E and G. It can be seen that, in the embodiment of the present disclosure, the feed object of each feed port is changed through a shift function of the radio frequency switch 3, thereby forming different antenna arrays in different states and extending coverage of the antenna array. Compared with the technical solution that each antenna array includes fixed array elements in the related art, an arraying manner for the antenna array in the embodiment of the present disclosure is more flexible. Of course, in another embodiment, five feed ports in the six feed ports of the radio frequency component 2 can be connected to the radio frequency switch 3, eight array elements in the nine array elements of the antenna structure 100 are connected with the radio frequency switch 3, and the other array element is directly connected with the other feed port of the radio frequency component 2. There are no limits made in the embodiment of the present disclosure.

It is to be noted that descriptions are made in the embodiment of the present disclosure only with corresponding relationships between the feed ports and the array elements in the two states as examples and, in another embodiment, there can also be another corresponding relationship between the feed ports and the array elements, of course, thereby forming a third antenna array or a fourth antenna array, etc. Elaborations are omitted herein. The radio frequency component 2 can include one or more of an amplifier, a filter and a frequency converter. There are no limits made in the embodiment of the present disclosure.

Figure 2:
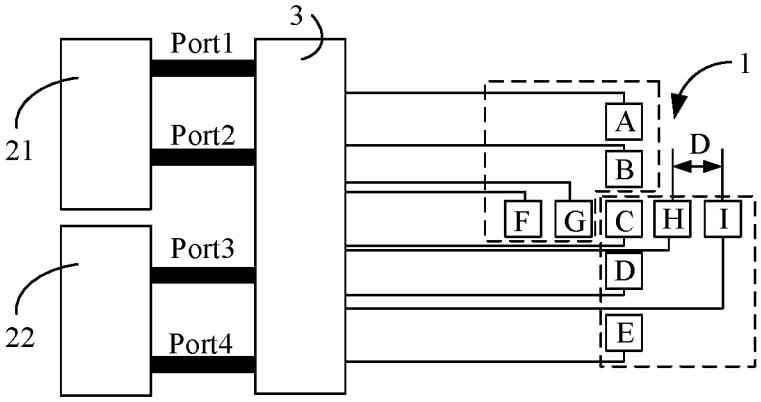
FIG. 2 is a portion block diagram of another antenna structure, according to some embodiments of the present disclosure.

In the embodiment, still as illustrated in FIG. 1, the antenna structure 100 can include a single radio frequency component 2, the single radio frequency component 2 can include a plurality of feed ports, and all the plurality of feed ports are connected with the radio frequency switch 3, so that the number of radio frequency components 2 carried in the antenna structure 100 can be reduced, and production cost can be reduced. In another embodiment, as illustrated in FIG. 2, the antenna structure 100 can also include a plurality of radio frequency components, at least one radio frequency component in the plurality of radio frequency components can include a plurality of feed ports, and each feed port can correspond to at least one array element. As illustrated in FIG. 2, the antenna structure 100 can include a first radio frequency component 21 and a second radio frequency component 22, the first radio frequency component 21 can include feed ports Port1 and Port2, and the second radio frequency component 22 can include feed ports Port3 and Port4.

In an embodiment, each feed port can correspond to a plurality of array elements. As illustrated in FIG. 2, the feed port Port1 corresponds to the array element A and the array element B, the feed port Port2 corresponds to the array element F and the array element G, and both the feed ports Port1 and Port2 are connected to the radio frequency switch 3, and a feed object of the first radio frequency component 21 can be shifted through the radio frequency switch, namely connection between the feed port Port2 and the array element A or connection between the Port1 and the array element B can be implemented through the radio frequency switch 3 and connection between the feed port Port2 and the array element F or connection between the feed port Port2 and the array element G can be implemented through the radio frequency switch 3. Similarly, the second radio frequency component 22 can correspond to the array elements C, D, E, H and I in the right upper dashed box in FIG. 2, the feed port Port3 corresponds to the array element C, the array element D and the array element E, the feed port Port4 corresponds to the array element H and the array element I, both the feed ports Port3 and Port4 are connected to the radio frequency switch 3, and a feed object of the second radio frequency component 22 can be shifted through the radio frequency switch 3, namely connection between the feed port Port3 and the array element C or connection between the feed port Port3 and the array element D or connection between the feed port Port3 and the array element E can be implemented through the radio frequency switch 3 and connection between the feed port Port4 and the array element H or connection between the feed port Port4 and the array element I can be implemented through the radio frequency switch 3. Of course, descriptions are made herein only with the first radio frequency component 21 and the second radio frequency component 22 as an example. The antenna structure 100 can also include three or more than three radio frequency components 2, of course. Exemplary descriptions are also made only through corresponding relationships between each of the first radio frequency component 21 and the second radio frequency component 22 and the array elements in FIG. 2, and there can also be another corresponding relationship, of course. There are no limits made in the embodiment of the present disclosure.

In another embodiment, the feed port of the radio frequency component 2 connected with the radio frequency switch 3 can also correspond to one array element, so that a working state of the array element corresponding to each feed port can be shifted through the radio frequency switch 3. For example, for the feed port Port1 of the first radio frequency component 21, the feed port Port1 can correspond to the array element A only, then the feed port Port1 can be connected with the array element A through the radio frequency switch 3 to shift the array element A into the working state, and the feed port Port1 can be disconnected from the array element A through the radio frequency switch 3 to shift the array element A into an off-working state.

In various embodiments as described above, a distance between two adjacent array elements is not greater than a wavelength when the antenna structure 100 is at a preset working frequency. For example, as illustrated in FIG. 2, if the antenna structure 100 can transmit a millisecond wave of the preset working frequency, a distance D between the array element H and the array element I is less than or equal to a wavelength of the millisecond wave of the preset working frequency. For example, the distance can be equal to a distance of a half or one third of a wavelength of the millisecond wave of the preset working frequency. There are no limits made in the embodiment of the present disclosure. The distance D can be a distance between a center of the array element H and a center of the array element I. If the antenna structure 100 is configured to transmit a 5G signal, the preset working frequency can be 26 GHz to 49 GHz, and the distance can be a wavelength of a millisecond wave of any working frequency within the range of 26 GHz to 49 GHz. Of course, descriptions are made herein only with the condition that the antenna structure 100 transmits a millisecond wave as an example. In another embodiment, the antenna structure 100 can also transmit an electromagnetic wave within another frequency band, of course. There are no limits made in the embodiment of the present disclosure.

Figure 3:
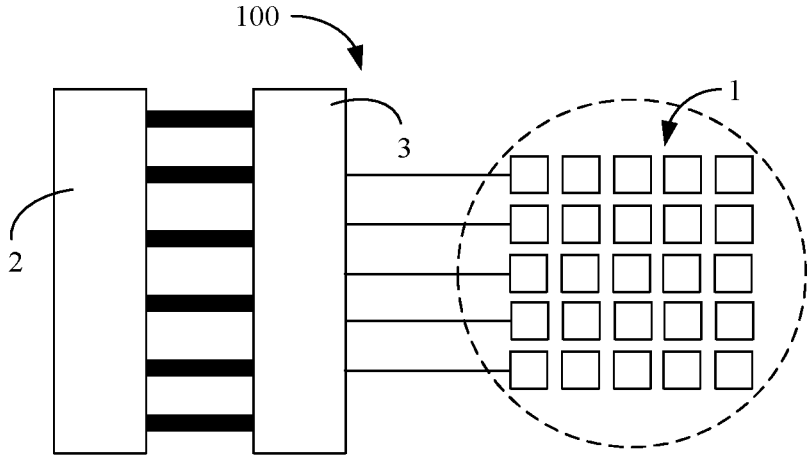
FIG. 3 is a portion block diagram of yet another antenna structure, according to some embodiments of the present disclosure.

In the embodiment, the plurality of array elements can be arranged in a preset range, and the preset range is a range taking an arrangement center of the plurality of array elements as a circle center and taking two times of wavelength when the antenna structure is at the preset working frequency as a radius. As illustrated in FIG. 3, the preset range is a range represented by the dashed circle in the figure, and each array element in the preset range is connected with the radio frequency switch 3.

Figure 4:
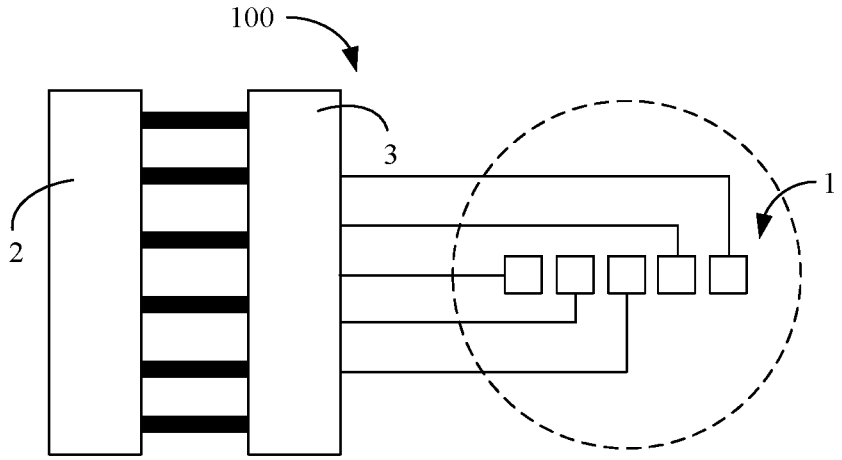
FIG. 4 is a portion block diagram of still another antenna structure, according to some embodiments of the present disclosure.
Figure 5:
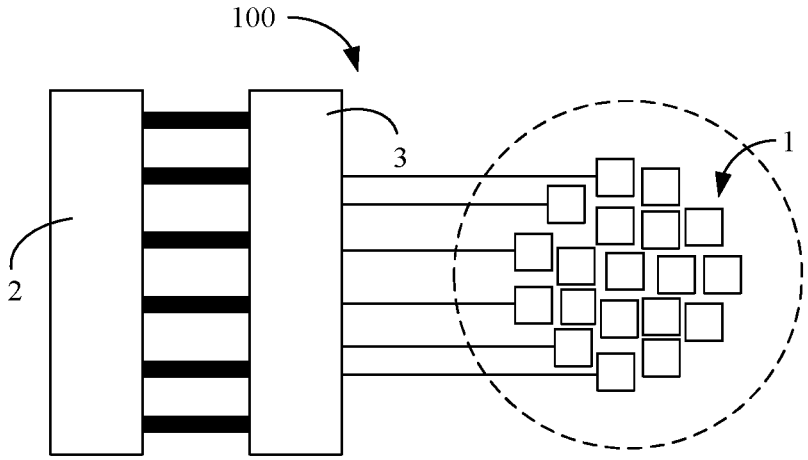
FIG. 5 is a portion block diagram of still another antenna structure, according to some embodiments of the present disclosure.

In various embodiments as described above, the plurality of array elements can form an irregular shape and can also form a regular shape, for example, a cross illustrated in FIG. 1 and FIG. 2, or a square illustrated in FIG. 3, or a straight line illustrated in FIG. 4 or a round illustrated in FIG. 5. There are no limits made in the embodiment of the present disclosure. The antenna structure 100 can include a 5G millimeter wave antenna to enhance communication performance of an electronic device. The electronic device configured with the antenna structure 100 provided in the embodiments of the present disclosure can include a handheld terminal, for example, a mobile phone and a tablet computer; or the electronic device can also include a wearable device, for example, a smart watch; or the electronic device can also include a smart home device.

Figure 6:
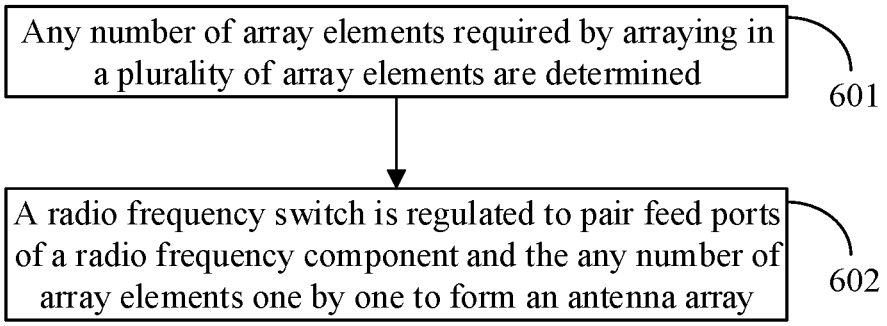
FIG. 6 is a flowchart illustrating an arraying method for an antenna structure, according to some embodiments of the present disclosure.

Based on the technical solutions of the embodiments of the present disclosure, as illustrated in FIG. 6, an arraying method for the antenna structure of any abovementioned embodiment is also provided. The arraying method can include the following blocks.

In Block 601, any number of array elements required by arraying in a plurality of array elements are determined.

In the embodiment, an electronic device can determine the array elements required by arraying according to a present communication requirement. For example, the array elements for arraying can be determined according to an amplitude and phase of each array element or a directional diagram and phase difference of a required antenna array.

In Block 602, a radio frequency switch is regulated to pair feed ports of a radio frequency component and the any number of array elements one by one to form an antenna array.

In the embodiment, the radio frequency switch can include a multi-pole multi-throw switch or a single-pole multi-throw switch, and is configured to shift a feed object of each feed port in the radio frequency component, and after the feed object of each feed port is changed, an antenna array structure can be changed.

Corresponding to the embodiment of the arraying method, the embodiments of the present disclosure also provide an embodiment of an arraying device.

Figure 7:
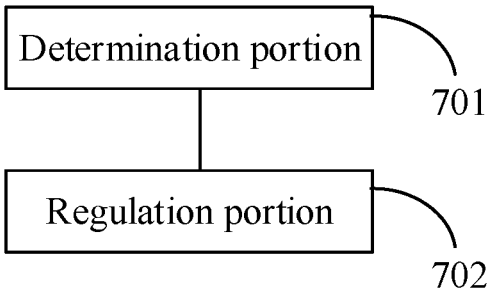
FIG. 7 is a flowchart illustrating an arraying method for an antenna structure, according to some embodiments of the present disclosure.

FIG. 7 is a block diagram of an arraying device for an antenna structure, according to some embodiments of the present disclosure. The antenna structure includes a plurality of array elements, a radio frequency switch and a radio frequency component. Referring to FIG. 7, the device includes a determination portion 701 and a regulation portion 702.

The determination portion 701 is configured to determine any number of array elements required by arraying in the plurality of array elements.

The regulation portion 702 is configured to regulate the radio frequency switch to pair feed ports of the radio frequency component and the any number of array elements one by one to form an antenna array.

With respect to the device in the above embodiment, the specific manners for performing operations for individual portions therein have been described in detail in the embodiment regarding the method, which will not be elaborated herein.

The device embodiment substantially corresponds to the method embodiment, and thus related parts refer to part of descriptions of the method embodiment. The device embodiment described above is only schematic, units described as separate parts therein may or may not be physically separated, and parts displayed as units may or may not be physical units, and namely may be located in the same place or may also be distributed to multiple network units. Part or all of the portions therein may be selected according to a practical requirement to achieve the purpose of the solution of the embodiment of the present disclosure. Those of ordinary skill in the art may understand and implement without creative work.

Correspondingly, the embodiments of the present disclosure also provide an arraying device for an antenna structure, which includes a processor and a memory configured to store processor-executable instructions. The antenna structure includes a plurality of array elements, a radio frequency switch and a radio frequency component. The processor is configured to determine any number of array elements required by arraying in the plurality of array elements and regulate the radio frequency switch to pair feed ports of the radio frequency component and the any number of array elements one by one to form an antenna array.

Correspondingly, the embodiments of the present disclosure also provide a terminal, which includes an antenna structure. The antenna structure includes a plurality of array elements, a radio frequency switch and a radio frequency component. The terminal includes a memory and one or more than one program. The one or more than one program is stored in the memory, and an instruction configured to execute the following operations in the one or more than one program is configured to be executed by one or more than one processor: any number of array elements required by arraying in the plurality of array elements are determined; and the radio frequency switch is regulated to pair feed ports of the radio frequency component and the any number of array elements one by one to form an antenna array.

Various embodiments of the present disclosure can have one or more of the following advantages.

The feed object of each feed port can be changed through a shift function of the radio frequency switch, thereby forming different antenna arrays in different states and extending coverage of the antenna array. Compared with the technical solution that each antenna array includes fixed array elements in the related art, an arraying manner for the antenna array in the embodiments of the present disclosure is more flexible.

Figure 8:
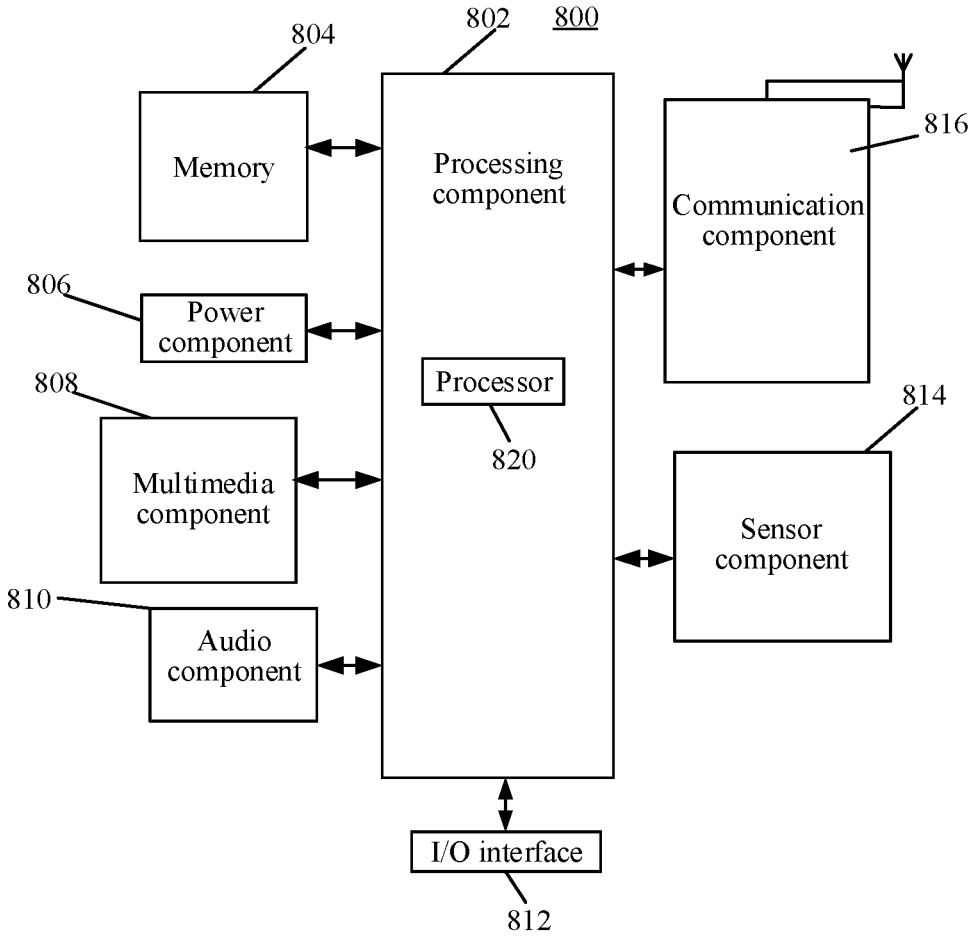
FIG. 8 is structure block diagram of an arraying device for an antenna structure, according to some embodiments of the present disclosure.

FIG. 8 is structure block diagram of an arraying device 800 for an antenna structure, according to some embodiments of the present disclosure. For example, the device 800 may be a mobile phone, a computer, a digital broadcast terminal, a messaging device, a gaming console, a tablet, a medical device, exercise equipment, a personal digital assistant and the like.

Referring to FIG. 8, the device 800 may include one or more of the following components: a processing component 802, a memory 804, a power component 806, a multimedia component 808, an audio component 810, an Input/Output (I/O) interface 812, a sensor component 814, and a communication component 816.

The processing component 802 typically controls overall operations of the device 800, such as the operations associated with display, telephone calls, data communications, camera operations, and recording operations. The processing component 802 may include one or more processors 820 to execute instructions to perform all or part of the blocks in the abovementioned method. Moreover, the processing component 802 may include one or more portions which facilitate interaction between the processing component 802 and the other components. For instance, the processing component 802 may include a multimedia portion to facilitate interaction between the multimedia component 808 and the processing component 802.

The memory 804 is configured to store various types of data to support the operation of the device 800. Examples of such data include instructions for any application programs or methods operated on the device 800, contact data, phonebook data, messages, pictures, video, etc. The memory 804 may be implemented by any type of volatile or non-volatile memory devices, or a combination thereof, such as an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, and a magnetic or optical disk.

The power component 806 provides power for various components of the device 800. The power component 806 may include a power management system, one or more power supplies, and other components associated with generation, management and distribution of power for the device 800.

The multimedia component 808 includes a screen providing an output interface between the device 800 and a user. In some embodiments, the screen may include a Liquid Crystal Display (LCD) and a Touch Panel (TP). In some embodiments, organic light-emitting diode (OLED) or other types of displays can be employed. If the screen includes the TP, the screen may be implemented as a touch screen to receive an input signal from the user. The TP includes one or more touch sensors to sense touches, swipes and gestures on the TP. The touch sensors may not only sense a boundary of a touch or swipe action but also detect a duration and pressure associated with the touch or swipe action. In some embodiments, the multimedia component 808 includes a front camera and/or a rear camera. The front camera and/or the rear camera may receive external multimedia data when the device 800 is in an operation mode, such as a photographing mode or a video mode. Each of the front camera and the rear camera may be a fixed optical lens system or have focusing and optical zooming capabilities.

The audio component 810 is configured to output and/or input an audio signal. For example, the audio component 810 includes a Microphone (MIC), and the MIC is configured to receive an external audio signal when the device 800 is in the operation mode, such as a call mode, a recording mode and a voice recognition mode. The received audio signal may further be stored in the memory 804 or sent through the communication component 816. In some embodiments, the audio component 810 further includes a speaker configured to output the audio signal.

The I/O interface 812 provides an interface between the processing component 802 and a peripheral interface module, and the peripheral interface module may be a keyboard, a click wheel, a button and the like. The button may include, but not limited to: a home button, a volume button, a starting button and a locking button.

The sensor component 814 includes one or more sensors configured to provide status assessment in various aspects for the device 800. For instance, the sensor component 814 may detect an on/off status of the device 800 and relative positioning of components, such as a display and small keyboard of the device 800, and the sensor component 814 may further detect a change in a position of the device 800 or a component of the device 800, presence or absence of contact between the user and the device 800, orientation or acceleration/deceleration of the device 800 and a change in temperature of the device 800. The sensor component 814 may include a proximity sensor configured to detect presence of an object nearby without any physical contact. The sensor component 814 may also include a light sensor, such as a Complementary Metal Oxide Semiconductor (CMOS) or Charge Coupled Device (CCD) image sensor, configured for use in an imaging APP. In some embodiments, the sensor component 814 may also include an acceleration sensor, a gyroscope sensor, a magnetic sensor, a pressure sensor or a temperature sensor.

The communication component 816 is configured to facilitate wired or wireless communication between the device 800 and other equipment. The device 800 may access a communication-standard-based wireless network, such as Wireless Fidelity (Wi-Fi), 2nd-Generation (2G) or 3rd-Generation (3G), $4^{th}$-Generation (4G), Long Term Evolution (LTE), 5G New Radio (NR) or a combination thereof. In some embodiments of the present disclosure, the communication component 816 receives a broadcast signal or broadcast associated information from an external broadcast management system through a broadcast channel. In some embodiments of the present disclosure, the communication component 816 further includes a Near Field Communication (NFC) module to facilitate short-range communication. For example, the NFC module may be implemented based on a Radio Frequency Identification (RFID) technology, an Infrared Data Association (IrDA) technology, an Ultra-WideBand (UWB) technology, a Bluetooth (BT) technology and another technology.

In some embodiments of the present disclosure, the device 800 may be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors or other electronic components, and is configured to execute the abovementioned method.

In some embodiments of the present disclosure, there is also provided a non-transitory computer-readable storage medium including an instruction, such as the memory 804 including an instruction, and the instruction may be executed by the processor 820 of the device 800 to implement the abovementioned method. For example, the non-transitory computer-readable storage medium may be a ROM, a Compact Disc Read-Only Memory (CD-ROM), a magnetic tape, a floppy disc, an optical data storage device and the like.

Other implementation solutions of the present disclosure will be apparent to those skilled in the art from consideration of the specification and practice of the embodiments of the present disclosure. This disclosure is intended to cover any variations, uses, or adaptations of the embodiments of the present disclosure following the general principles thereof and including such departures from the embodiments of the present disclosure as come within known or customary practice in the art. It is intended that the specification and examples be considered as exemplary only, with a true scope and spirit of the embodiments of the present disclosure being indicated by the following claims.

In the embodiments of the present disclosure, the feed object of each feed port is changed through a shift function of the radio frequency switch, thereby forming different antenna arrays in different states and extending coverage of the antenna array. Compared with the technical solution that each antenna array includes fixed array elements in the related art, an arraying manner for the antenna array in the embodiment of the present disclosure is more flexible.

In the present disclosure, the terms "installed," "connected," "coupled," "fixed" and the like shall be understood broadly, and can be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

In some embodiments, the control and/or interface software or app can be provided in a form of a non-transitory computer-readable storage medium having instructions stored thereon is further provided. For example, the non-transitory computer-readable storage medium can be a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium can be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a standalone program or as a portion, component, subroutine, object, or other portion suitable for use in a computing environment. A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), a CRT (cathode-ray tube), LCD (liquid-crystal display), OLED (organic light emitting diode), or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components.

The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

In the description of the present disclosure, the terms "some embodiments," "example," or "some examples," and the like may indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described may be combined in a suitable manner in any one or more embodiments or examples. In addition, various embodiments or examples described in the specification, as well as features of various embodiments or examples, may be combined and reorganized.

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombinations.

Moreover, although features can be described above as acting in certain combinations and even initially claimed as such, one or more features from a claimed combination can in some cases be excised from the combination, and the claimed combination can be directed to a subcombination or variations of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

The invention claimed is:

1. An antenna structure, comprising:

a plurality of array elements;

at least one radio frequency component comprising a plurality of feed ports; and a radio frequency switch directly connected between at least two array elements and at least two feed ports among the plurality of feed ports, and configured to switch a feed object of each feed port connected to the radio frequency switch based on different states to form a preset antenna array, wherein in the different states, the plurality of feed ports have different correspondences with the plurality of array elements;

wherein the feed object is any array element of the at least two array elements connected to the radio frequency switch, wherein the at least one radio frequency component further comprises a plurality of radio frequency components, wherein each of the at least one first radio frequency component comprises a plurality of feed ports, and each feed port corresponds to at least one array element; and each of the at least one first radio frequency component is directly connected to the radio frequency switch, and the radio frequency switch directly connected between the plurality of array elements and the plurality of feed ports is configured to switch a feed object corresponding to each feed port.

2. The antenna structure of claim 1, wherein a distance between two adjacent array elements is less than or equal to a wavelength when the antenna structure is at a preset working frequency.

3. The antenna structure of claim 2, wherein the plurality of array elements are arranged in a preset range, and the preset range is a range taking an arrangement center of the plurality of array elements as a circle center and taking two times of wavelength when the antenna structure is at the preset working frequency as a radius.

4. The antenna structure of claim 2, wherein the plurality of array elements are arranged in a shape of at least one of:

a round, a square, a cross, or a straight line.

5. The antenna structure of claim 1, further comprising a 5th-Generation (5G) millimeter wave antenna.

6. An electronic device, comprising an antenna structure, the antenna structure comprising:

a plurality of array elements;

at least one radio frequency component comprising a plurality of feed ports; and a radio frequency switch directly connected between at least two array elements and at least two feed ports among the plurality of feed ports, and configured to switch a feed object of each feed port connected to the radio frequency switch based on different states to form a preset antenna array, wherein in the different states, the plurality of feed ports have different correspondences with the plurality of array elements;

wherein the feed object is any array element of the at least two array elements connected to the radio frequency switch, wherein the at least one radio frequency component comprises a plurality of radio frequency components, wherein each of the at least one first radio frequency component comprises a plurality of feed ports, and each feed port corresponds to at least one array element; and each of the at least one first radio frequency component is directly connected to the radio frequency switch, and the radio frequency switch directly connected between the plurality of array elements and the plurality of feed ports is configured to switch a feed object corresponding to each feed port.

7. The electronic device of claim 6, wherein a distance between two adjacent array elements is less than or equal to a wavelength of the antenna structure being at a preset working frequency.

8. The electronic device of claim 7, wherein the plurality of array elements are arranged in a preset range, and the preset range is a range taking an arrangement center of the plurality of array elements as a circle center and taking two times of the wavelength of the antenna structure being at the preset working frequency as a radius.

9. The electronic device of claim 7, wherein the plurality of array elements are arranged in at least one of:

a round shape, a square shape, a cross shape, or a straight line shape.

10. The electronic device of claim 6, further comprising a 5th-Generation (5G) millimeter wave antenna.

11. An arraying method for an antenna structure, the antenna structure comprising a plurality of array elements, at least one radio frequency component comprising a plurality of feed ports, and a radio frequency switch directly connected between the at least two array elements and at least two feed ports among the plurality of free ports, and configured to switch a feed object of each feed port connected to the radio frequency switch based on different states, to form a preset antenna, wherein in the different states, the plurality of feed ports have different correspondences with the plurality of array elements, wherein the at least one radio frequency component comprises a plurality of radio frequency components, wherein each of the at least one first radio frequency component comprises a plurality of feed ports, and each feed port corresponds to at least one array element; and each of the at least one first radio frequency component is directly connected to the radio frequency switch, and the radio frequency switch directly connected between the plurality of array elements and the plurality of feed ports is configured to switch a feed object corresponding to each feed port, the arraying method comprising:

determining any number of array elements required by arraying in the plurality of array elements; and regulating the radio frequency switch to pair feed ports of the at least one radio frequency component and the any number of array elements one by one to form an antenna array.

12. A non-transitory computer-readable storage medium having instructions stored thereon for execution by a processor of a terminal to enable the terminal to implement the arraying method for an antenna structure of claim 1.

13. A mobile phone comprising the antenna structure according to claim 1, wherein the mobile phone is configured to change a feed object of each feed port through a shift function of the radio frequency switch, thereby forming different antenna arrays in different states.

14. The mobile phone of claim 13, wherein a distance between two adjacent array elements is less than or equal to a wavelength of the antenna structure being at a preset working frequency.

15. The mobile phone of claim 14, wherein the plurality of array elements are arranged in a preset range, and the preset range is a range taking an arrangement center of the plurality of array elements as a circle center and taking two times of the wavelength of the antenna structure being at the preset working frequency as a radius.

* * * * *